US005224618A

United States Patent [19]

Garbiso

[11] Patent Number: 5,224,618

[45] Date of Patent: Jul. 6, 1993

[54] EASY OPENING TAB FOR CONTAINER

[76] Inventor: Michael J. Garbiso, 2107 Starfall, Chino, Calif. 91709

[21] Appl. No.: 902,066

[22] Filed: Jun. 22, 1992

[51] Int. Cl.[5] ..... B65D 17/34

[52] U.S. Cl. ..... 220/269

[58] Field of Search ..... 220/269, 270, 271, 272, 220/273, 276

[56] References Cited

U.S. PATENT DOCUMENTS

| | | | |
|---|---|---|---|
| 3,250,425 | 5/1966 | Stec et al. | 220/273 |
| 3,341,055 | 9/1967 | Radford | 220/273 |
| 4,951,835 | 8/1990 | DeMars et al. | 220/269 |
| 5,038,956 | 8/1991 | Saunders | 220/271 |
| 5,131,555 | 7/1992 | DeMars et al. | 220/269 |

*Primary Examiner*—Allan N. Shoap
*Assistant Examiner*—Nova Stucker
*Attorney, Agent, or Firm*—Boniard I. Brown

[57] ABSTRACT

An improved easy opening tab arrangement for an easy opening container of the kind often referred to as a pop-top container. A container opening tab having a ring at one end and an opposite free end is pivotally mounted between its ends on a container wall having a pair of raised formations, such as inclined ramp formations. The tab is rotatable about a first axis normal to the wall between a storage position in which the tab lies flat against the wall with the tab ring encircling one raised formation and the other raised formation disposed along one longitudinal side of the ring, and a container opening position in which the tab ring seats on the raised formations to space the ring from the wall, and the free tab end overlies an integral frangible seal forming portion of the wall. While in its container opening position, the tab is rotatable about a second axis transverse to both the first axis and the longitudinal axis of the tab to press the tab free end against and thereby rupture the frangible seal.

4 Claims, 2 Drawing Sheets

EASY OPENING TAB FOR CONTAINER

BACKGROUND OF THE INVENTION

1. Field of the Invention

This invention relates generally to easy opening containers of the kind having a tab which is flipped upwardly to open the container. The invention relates more particularly to an easy opening container having an improved easy opening tab arrangement which facilitates engagement of a finger under the tab to lift it.

2. PRIOR ART

Beverages are commonly sold in easy opening containers which are opened by lifting one end, referred to herein as its lifting end, of a lever-like tab pivotally attached between its ends to the normally upper end wall of the container. The opposite end of the tab, referred to as its free end, overlies a portion of the end wall forming a seal which effectively closes an opening in the wall through which the contents of the container, when opened, is dispensed. This seal is integrally joined to the surrounding container end wall along a major part of the seal perimeter by a narrow frangible juncture defining a frangible parting line between the seal and the surrounding end wall. Along the remainder of its perimeter, the seal is integrally joined to the surrounding end wall by a bendable juncture which is referred to herein as a hinge.

The container is opened by flipping up the lifting end of the tab. This action pivots the tab about its pivotal attachment to the container end wall in a direction to rotate the free end the tab downwardly against the container seal. The thrust of the free tab end against the seal first ruptures the container end wall along the frangible parting line, and then folds the seal downwardly about its hinge and into the container to form a dispensing opening in the end wall.

The prior art is replete with a vast assortment of easy opening containers of this kind. Examples of such containers are described in the following U.S. Pat. Nos.: 4,417,668; 4,433,792; 4,446,985; 4,576,304; 4,605,141; 4,720,022; 4,951,835. Of these, the DeMars et al U.S. Pat. No. 4,951,835 is perhaps the most pertinent to this invention because of certain of its features which are discussed below.

The existing easy opening containers are difficult to open because the tab is pivotally attached to the upper container end wall by a rivet or other means which normally holds the tab firmly against the upper container end wall. The tab is thus held firmly against the container end wall to facilitate fabrication of the containers and to permit stacking of the finished containers. Thus, during container manufacture, the upper container end walls are fabricated separately from the rest of the container body in the form of lids having a circular wall (upper container end wall) and a channel-like rim about the perimeter of the wall. The walls of these lids contain the seal-forming frangible and bendable hinge junctures and mount the easy opening tabs. During container fabrication, these lids are stacked and placed in automatic container fabricating machines which fold the rims of the lids downwardly over the ends of the cylindrical side walls of the container bodies and solder or otherwise seal the lids to these side walls in such a way as to form raised stacking beads or rims about the upper ends of the finished containers. Proper stacking of the lids during container fabrication and stacking of the finished containers requires that the easy opening tabs be normally lie firmly against the lid walls and upper end walls of the finished containers, as just mentioned. As a consequence, it is very difficult to get a finger under the lifting end of the tab to flip it up. For this reasons, many persons, particularly those with long finger nails, resort to the use of a slender implement of some kind to pry the tab up, at least enough to get a finger under the tab.

Attempts have been made to solve this problem in various ways. For example, the upper end walls of some containers have a shallow recess under the lifting end of the tab which provides a space between the tab and the floor of the recess to facilitate engagement of a finger under the tab. U.S. Pat. No. 4,951,835 provides such a space in a different way. The easy opening tab in this patent is rotatable about its pivotal attachment to the upper container end wall between a container stowage position and a container opening position. The container end wall has a cam over which the lifting end of the tab rides as it enters its container opening position, and which raises the lifting end of the tab upwardly away from the end wall to provide a space between the end wall and the lifting end.

SUMMARY OF THE INVENTION

This invention provides an easy opening container having an improved easy opening tab arrangement which provides a space under the lifting end of the tab to facilitate upward flipping of the tab to open the container. The container comprises certain typical easy opening container structure including a wall having a portion which forms a seal surrounded by the remainder of the wall. The seal is integrally joined to the surrounding wall along a major portion of the seal perimeter by a narrow frangible juncture which defines a frangible parting line between the seal and the surrounding wall, and along the remainder of the seal perimeter by a bendable juncture forming a hinge. A container easy opening tab having a ring-shaped lifting end and an opposite free end is pivotally mounted between its ends on the surrounding wall.

According to the present invention, the container wall is provided with a pair of raised formations opposite the seal hinge. The easy opening tab is pivotally mounted on the wall for rotation about a first pivot axis transverse to the wall and to the longitudinal axis of the tab and situated between the seal hinge and the raised formations, and for rotation about a second pivot axis transverse to both the first pivot axis and the longitudinal axis of the tab. The tab is rotatable about its first pivot axis between a container storage position and a container opening position. During rotation of the tab from the storage position to the container opening position, the ring at the lifting end of the tab moves along a curved line. The two raised formations on the container wall are spaced along this direction line in such a way that (a) when the tab occupies its storage position, it lies flat against the container wall with the tab ring surrounding one raised formation and the other raised formation situated along one side of the ring and with the upper sides of the tab and raised formations substantially flush with one another so as to permit stacking of container lids during container fabrication, and stacking of finished containers, as mentioned above, and (b) when the tab occupies its container opening position, opposite sides of the tab ring rest on the raised formations, respectively, to space the tab lifting end from the container wall, the free end of the tab overlies the container seal, and the tab is rotatable about its second pivot axis to open the container by pressing its free end against the seal to rupture the frangible juncture between the seal and surrounding container wall and then fold the seal into the container.

The preferred embodiment of the invention is a cylindrical beverage container in which the seal, easy opening tab and raised formations are located on the normally upper container end wall. The raised formations are inclined ramps which slope upwardly away from the container end wall in the direction of rotation of the tab from its storage position to its container opening position. During rotation of the tab from its storage position to its container opening position, opposite sides of the tab ring slide upwardly along these ramps to space the ring from the container end wall.

A major advantage of the invention resides in the fact that it can be utilized on most, if not all, existing easy opening beverage containers and many other easy opening containers because the easy opening tabs of these containers have a ring at their lifting end. Another advantage of the invention is that the rotational movement of the tab from its container storage position to its container opening position is minimized.

DESCRIPTION OF THE PREFERRED EMBODIMENT

Figure 1:
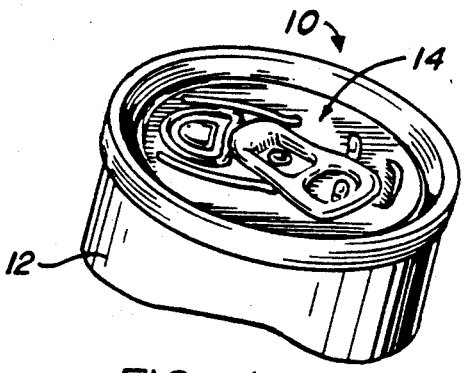
FIG. 1 is a fragmentary perspective view of an easy opening container according to the invention, showing the easy opening tab in its storage position.

Turning now to these drawings, there is illustrated an improved easy opening container 10 embodying an improved easy opening tab arrangement 12 according to this invention. The illustrated container is a beverage container which comprises certain conventional easy opening container structure which is utilized with most if not all easy opening beverage containers now on the market. As noted earlier, a primary advantage of the invention resides in the fact that the invention may be embodied on such widely used beverage containers.

Thus, the body of the container 10 includes a cylindrical side wall 12, an upper end wall 14 joined and sealed about its permimeter to the upper edge of the side wall, and a lower end wall (not shown) joined and sealed about its permimeter to the lower edge of the side wall. The upper end wall 14 has a portion 16 which forms a seal surrounded by the remaining upper end wall portion 18. The seal 16 is integrally joined to the surrounding wall portion 18, along a major portion of the seal perimeter (the left end and upper and lower seal side in the drawings), by a narrow frangible juncture 20 which defines a frangible parting line between the seal and the surrounding wall, and along the remainder of the seal perimeter (the right seal end in the drawings) by a bendable juncture 22 forming a hinge. A container easy opening tab 24 having a ring-shaped lifting end 26 and an opposite free end 28 is pivotally mounted between its ends on the surrounding wall portion 18 by pivot means 30. In this case, the pivot means 30 is a rivet which extends through a flexible lip 31 on the tab and normally holds the tab flat against the wall 14. The above container structure is conventional and is typical of that of most, if not all beverage containers on the market to day.

According to the present invention, the upper container end wall 14 is provided with a pair of raised formations 32, 34 opposite and to the right of the right hand hinged side of end of the seal 16 in the drawings. The pivot means or rivet 30 pivotally mounts the easy opening tab 24 on the end wall for rotation about a first pivot axis (the longitudinal axis of rivet 30) transverse to the wall and to the longitudinal axis of the tab, and situated between the right hand hinged side or end of the seal 16 in the drawings and the raised formations 32, 34, and for rotation about a second pivot axis transverse to and intersecting both the first pivot axis and the longitudinal axis of the tab. The tab is rotatable about its first pivot axis between a storage position shown in FIGS. 1 and 2 and a container opening position shown in FIGS. 3, 4, 6 and 7.

Figure 6:
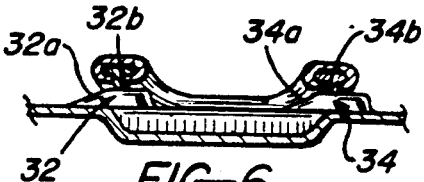
Figure 7:
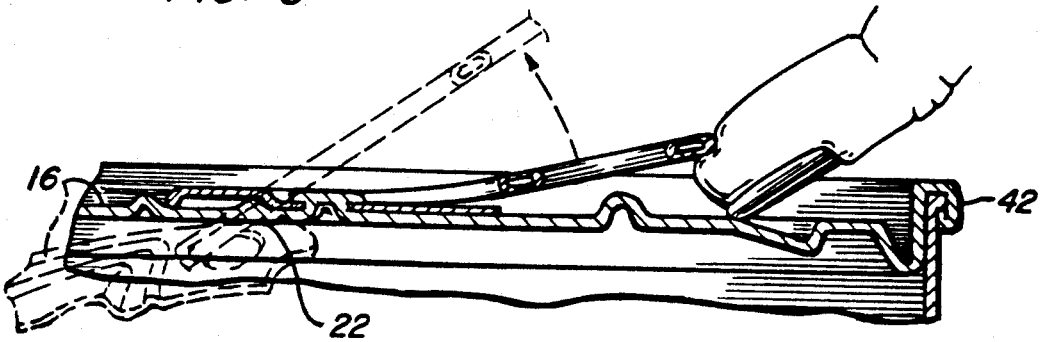
Figure 9:
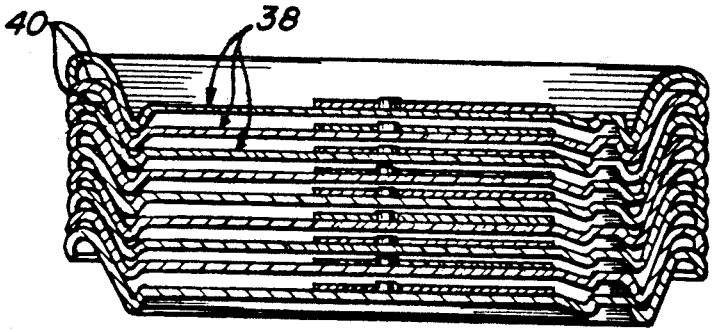
FIG. 9 is an enlarged section taken on line 9—9 in FIG. 8.
Figure 10:
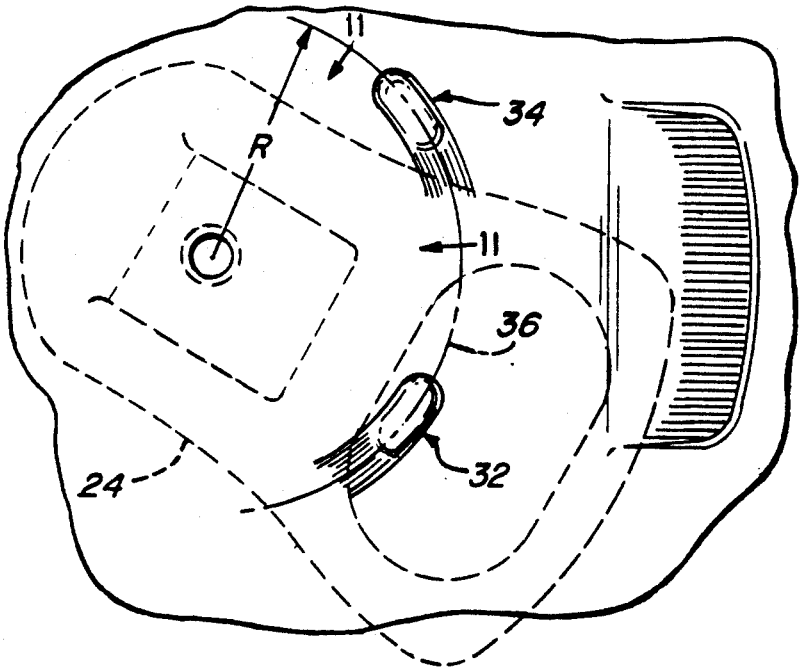
FIG. 10 is an enlarged fragmentary plan view of the upper end of a container according to the invention.

During rotation of the tab 24 about the axis of the rivet 30 from its storage position to its container opening position, the center of the tab ring 26 moves along a curved direction line 36 (FIG. 10). The two raised formations 32, 34 on the container end wall 14 are spaced along this direction line as best shown in FIG. 10. When the tab 24 occupies its storage position, it lies flat against the container wall with the tab ring 26 surrounding one raised formation, in this case formation 32, and the other raised formation 34 situated along the leading side of the ring relative to its direction of rotation in FIG. 2. The upper sides of the tab and raised formations are then substantially flush with one another so as to permit stacking of container lids 38 (FIGS. 8, 9) during container fabrication and stacking of finished containers, as mentioned earlier and described later. When the tab 24 occupies its container opening position, opposite sides of the tab ring 26 rest on the raised formations 32, 32, respectively, as shown in FIGS. 3, 4, and 6 to space the tab ring from the container wall 14. The free end 28 of the tab 24 then overlies the container seal 16 adjacent its right hand hinge side or end in the drawings. In this position, the tab ring 26 is rotatable upwardly about the tab pivot axis transverse to its longitudinal axis and to the axis of rivet 30 to rotate the free tab end 28 downwardly against the seal 16, as shown in FIG. 7. The downward force thus exerted on the seal ruptures the frangible juncture 20 between the seal and surrounding container wall portion 18 and then folds the seal into the container.

Figure 2:
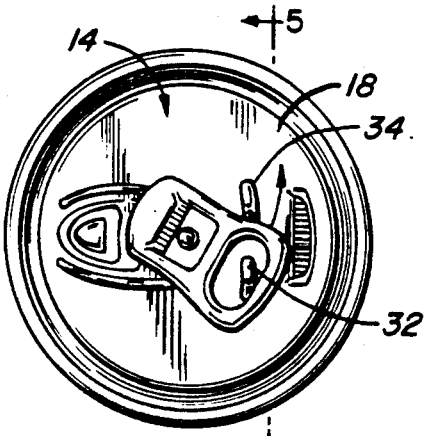
FIG. 2 is a plan view of the container in FIG. 1.
Figure 3:
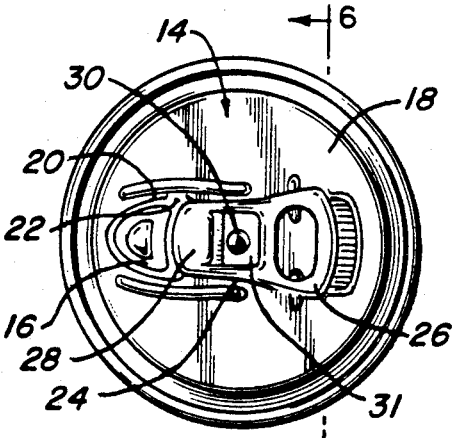
FIG. 3 is plan view similar to FIG. 2, showing the tab in its container opening position.
Figure 4:
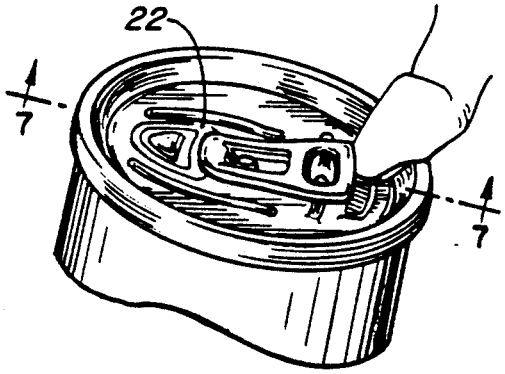
FIG. 4 is a fragmentary perspective view of the container showing the easy opening tab being lifted to open the container.
Figure 5:
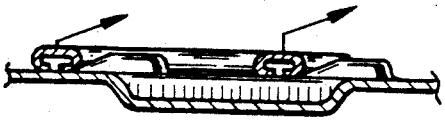
FIGS. 5-7 are enlarged sections taken on lines 5-7, respectively, in FIGS. 2-4.
Figure 11:
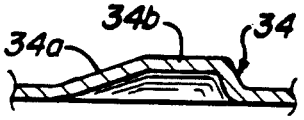
FIG. 11 is a section taken on line 11—11 in figure 10.

As may be best observed in FIGS. 6 and 11, the preferred raised formations 32, 34 illustrated are are inclined ramps having upper edge or surface portions **32*a*, 34*a* which slope upwardly away from the container end wall 14 in the direction of rotation of the tab 24 from its storage position of FIGS. 1 and 2 to its container opening position of FIGS. 3, 4, and 6, and then continue in plateau portions 32*b*, 34*b* parallel to the end wall. During rotation of the tab from the storage position to the container opening position, opposite sides of the tab ring 26 slide upwardly along the inclined ramp portions 32***a*, 34*a* to the ramp plateau portions 32*b*, 34*b* to space the tab ring from the container end wall. This permits a person to easily engage a finer under the tab ring and flip the ring upward to open the container seal 16.

A major advantage of the improved tab arrangement resides in the fact that it can be utilized on most if not all existing easy opening beverage containers and many other easy opening containers, because the easy opening tabs of these containers have a ring at their lifting end. In this regard, it will be recognized that the illustrated container, except for its raised formations or ramps 32, 34 is typical of most or all beverage containers now on the market. Another advantage of the invention is that the rotational movement of the tab 24 from its container storage position to its container opening position is minimized.

Figure 8:
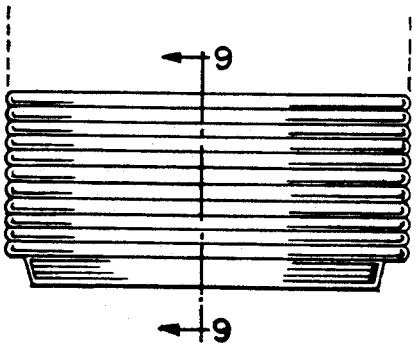
FIG. 8 illustrates a stack of container lids used in the fabrication of containers according to the invention.

As mentioned earlier, the easy opening containers on the market are difficult to open because their tab is pivotally attached to the upper container end wall in a manner which normally holds the tab firmly against the upper container end wall. The tab is thus held firmly against the container end wall to facilitate fabrication of the containers and to permit stacking of the finished containers. Thus, during container manufacture, the upper container end walls are fabricated separately from the rest of the container body, in the form of lids. FIGS. 8 and 9 illustrate such lids 38 embodying the improved easy opening tab arrangement of this invention. Lids 38 have a circular wall which forms the upper container end wall 14 and an upwardly, outwardly and then downwardly arching rim 40 about the perimeter of the wall. The lid wall 14 is formed with the seal-forming frangible and bendable hinge junctures 20, 22 and the ramp formations 32, 34 and mounts the easy opening tab 24. During container fabrication, a number of these lids are stacked in the manner shown in FIG. 9 and placed in an automatic container fabricating machine. This machine assembles each lid on the upper end of a container body 12, folds the rim 40 of the lid around the end of the body, and solders or otherwise seals the lid to the body in such a way as to form a raised stacking bead or rim 42 about the upper end of the finished container. Proper stacking of the lids 38 during container fabrication and stacking of the finished containers requires that their easy opening tabs 24 normally lie firmly against the lid/container walls 14 and the upper surfaces of their tabs, and their ramp formations 32, 24 are disposed below the level of the lid rims 40 and container rims 42. The improved easy opening tab arrangement of this invention meets this requirement.

I claim:

1. An easy opening tab arrangement for an easy opening container, comprising: a wall having an integral portion defining a seal surrounded by the remaining portion of the wall and integrally joined to said remaining wall portion along a major part of the seal perimeter by a narrow frangible juncture defining a parting line between the seal and said remaining wall portion and along the remainder of the seal perimeter by a bendable hinge juncture, whereby a force may be exerted on said seal to first rupture said frangible juncture along sad parting line and then fold said seal about said hinge juncture to form an opening in said wall, an elongate easy opening tab having a longitudinal axis, a lifting end forming a ring containing an opening, and an opposite free end, pivot means mounting said tab between its ends on said remaining wall portion for rotation of the tab about a first axis transverse to the wall and to the longitudinal axis of the tab and rotation of the tab about a second axis transverse to both said first axis and said longitudinal axis, whereby during rotation of said tab about said first axis said tab ring moves along a circular path concentric with said first axis, a pair of ramps spaced along said circular path each having opposite ends spaced along said path, whereby said ramps have first and second corresponding ends, and said ramps including plateau portions at said first ends spaced above said wall and inclined ramp portions at said second ends which slope upwardly from said wall to the respective plateau portions from said second ends toward said first ends, and wherein (a) said tab is rotatable about said first axis between a storage position wherein said tab ring lies flat against said wall and said tab free end is laterally offset relative to said seal, and a seal opening position wherein said tab free end overlies said seal, (b) said ramps are located at positions space along said path such that when said tab occupies sad storage position, said tab ring is disposed in surrounding relation to one ramp with circumferentially spaced portions of the ring located adjacent said second ramp ends, respectively, whereby movement of sad tab ring during rotation of said tab from its storage position to its seal opening position occurs in a direction from said second ramp ends toward said first ramp ends in a manner such that said ring undergoes simultaneous movement upwardly along both inclined ramp portions and onto said ramp plateau portions, and (c) said tab when in seal opening position is rotatable about said second axis to press said tab free end against said seal for rupturing said frangible juncture along said parting line and folding said seal about said hinge juncture.

2. An easy opening tab arrangement according to claim 1 wherein:

said ramps are curved substantially about said first axis.

3. An easy opening container, comprising:

a cylindrical container body including a normally upper end wall having an integral portion defining a seal surrounded by an adjacent portion of the wall and integrally joined to said adjacent wall portion along a major part of the seal perimeter by a narrow frangible juncture defining a parting line between said wall and said adjacent portion and along the remainder of the seal perimeter by a bendable hinge juncture, whereby a force ma be exerted on said seal to first rupture sad frangible juncture along said parting line and then fold said seal into the container about said hinge juncture to form an opening in said wall, an elongate easy opening tab having a longitudinal axis, a lifting end forming a ring and an opposite free end, pivot means mounting said tab between its ends on said remaining wall portion for rotation of the tab about a first axis transverse to the wall and to the longitudinal axis of the tab and for rotation about a second axis transverse to both said first axis and said longitudinal axis, whereby during rotation of said tab about said first axis said tab ring moves along a circular path concentric with said first axis, a pair of ramps spaced along said circular path each having opposite ends spaced along sad path, whereby sad ramps have first and second corresponding ends, and said ramps including plateau portions at said first ends spaced above said wall and inclined ramp portions at said second ends which slope upwardly from said wall to the respective plateau portions from said second ends toward said first ends, and wherein (a) said tab is rotatable about said first axis between a storage position wherein sad tab ring lies flat against said wall and said tab free end is laterally offset relative to said seal, and a seal opening position wherein said tab free end overlies said seal, (b) said ramps are located at positions spaced along said path such that when said tab occupies said storage position, said tab ring is disposed in surrounding relation to one ramp with circumferentially spaced portions of the ring located adjacent said second ramp ends, respectively, whereby movement of said tab ring during rotation of said tab from its storage position to its seal opening position occurs in a direction from sad second ramp ends toward said first ramp ends in a manner such that said ring undergoes simultaneous movement upwardly along both inclined ramp portions and onto said ramp plateau portions, and (c) said tab when in said seal opening position is rotatable about said second axis to press said tab free end against said seal for rupturing said frangible juncture along said parting line and folding said seal about said hinge juncture.

4. An easy opening container according to claim 3 wherein:

said ramps are curved substantially about said first axis.

* * * * *